US008766885B2

(12) United States Patent
Van de Ven et al.

(10) Patent No.: US 8,766,885 B2
(45) Date of Patent: Jul. 1, 2014

(54) TRUE COLOR FLAT PANEL DISPLAY MODULE

(75) Inventors: Antony P. Van de Ven, Cary, NC (US); Charles M. Swoboda, Cary, NC (US)

(73) Assignee: Cree, Inc., Durham, NC (US)

( * ) Notice: Subject to any disclaimer, the term of this patent is extended or adjusted under 35 U.S.C. 154(b) by 733 days.

(21) Appl. No.: 12/133,060

(22) Filed: Jun. 4, 2008

(65) Prior Publication Data

US 2008/0231567 A1 Sep. 25, 2008

Related U.S. Application Data

(60) Continuation of application No. 09/057,838, filed on Apr. 9, 1998, now Pat. No. 7,385,574, which is a division of application No. 08/580,771, filed on Dec. 29, 1995, now abandoned.

(51) Int. Cl.
*G09G 3/32* (2006.01)
*G09G 3/20* (2006.01)

(52) U.S. Cl.
CPC ..... *G09G 3/32* (2013.01); *G09G 2310/0275* (2013.01); *G09G 3/2014* (2013.01); *G09G 2300/06* (2013.01); *G09G 2320/0247* (2013.01); *G09G 2320/0666* (2013.01); *G09G 2300/0452* (2013.01); *G09G 2310/027* (2013.01)
USPC ..... 345/82; 345/83

(58) Field of Classification Search
CPC ..... G09G 3/06; G09G 3/22; G09G 3/32; G09G 3/3208; G09G 3/14
USPC ..... 345/39, 44–46, 75–78, 82–84
See application file for complete search history.

(56) References Cited

U.S. PATENT DOCUMENTS

| | | | | |
|---|---|---|---|---|
| 3,776,615 | A | 12/1973 | Tsukamoto et al. | |
| 4,180,813 | A | 12/1979 | Yoneda | |
| 4,368,963 | A | 1/1983 | Stolov | |
| 4,410,887 | A | 10/1983 | Stolov et al. | |
| 4,459,640 | A | 7/1984 | Latasiewicz et al. | 345/206 |
| 4,581,608 | A | 4/1986 | Aftergut et al. | |

(Continued)

FOREIGN PATENT DOCUMENTS

| | | | |
|---|---|---|---|
| CA | 2 171 244 | 9/1996 | |
| DE | 3837313 A1 | 11/1987 | H09G 3/32 |

(Continued)

OTHER PUBLICATIONS

*Perfecting the Picture*, C. M. Apt, IEEE Spectrum, Jul. 1985, pp. 60-66.

(Continued)

*Primary Examiner* — Regina Liang
(74) *Attorney, Agent, or Firm* — Myers Bigel Sibley & Sajovec P.A.

(57) ABSTRACT

A full color flat panel display module is formed of a matrix of pixels in rows and columns. Each pixel is formed of respective red, green and blue solid state light emitting diodes that can form any color on that portion of a CIE curve that falls within a triangle whose sides are formed by a line on the CIE curve between 430 nm and 660 nm, a line between 660 nm and a point between 500 and 530 nm, and a line between the 500-530 nm point and 430 nm.

20 Claims, 9 Drawing Sheets

(56) References Cited

U.S. PATENT DOCUMENTS

| | | | | |
|---|---|---|---|---|
| 4,712,878 | A | 12/1987 | Taniguchi et al. | |
| 4,716,403 | A | 12/1987 | Morozumi | |
| 4,734,619 | A | 3/1988 | Havel | 313/510 |
| 4,771,274 | A | 9/1988 | Havel | 345/83 |
| 4,772,886 | A | 9/1988 | Hasegawa | 340/825.82 |
| 4,799,050 | A | 1/1989 | Prince et al. | |
| 4,812,744 | A | 3/1989 | Havel | 324/115 |
| 4,868,496 | A | 9/1989 | Havel | 324/115 |
| 4,870,484 | A | 9/1989 | Sonehara | |
| 4,897,639 | A * | 1/1990 | Kanayama | 345/82 |
| 4,907,862 | A | 3/1990 | Suntola | |
| 4,918,497 | A | 4/1990 | Edmond | |
| 4,978,952 | A | 12/1990 | Irwin | |
| 4,992,704 | A | 2/1991 | Stinson | |
| 4,998,119 | A | 3/1991 | Collins et al. | |
| 5,019,807 | A | 5/1991 | Stapleton et al. | |
| 5,027,168 | A | 6/1991 | Edmond | |
| 5,063,421 | A | 11/1991 | Suzuki et al. | |
| 5,093,652 | A | 3/1992 | Bull et al. | |
| 5,103,328 | A | 4/1992 | Numao | |
| 5,115,286 | A | 5/1992 | Camras et al. | 257/94 |
| 5,134,387 | A | 7/1992 | Smith et al. | 340/701 |
| 5,164,798 | A | 11/1992 | Huang | 257/97 |
| 5,184,114 | A | 2/1993 | Brown | 340/701 |
| 5,187,547 | A | 2/1993 | Niina et al. | |
| 5,198,803 | A * | 3/1993 | Shie et al. | 345/82 |
| 5,243,204 | A | 9/1993 | Suzuki et al. | |
| 5,247,533 | A | 9/1993 | Okazaki et al. | |
| 5,273,933 | A | 12/1993 | Hatano et al. | |
| 5,278,542 | A | 1/1994 | Smith et al. | 345/150 |
| 5,290,393 | A | 3/1994 | Nakamura | |
| 5,300,788 | A | 4/1994 | Fan et al. | |
| 5,302,839 | A | 4/1994 | Kaise et al. | |
| 5,306,662 | A | 4/1994 | Nakamura et al. | |
| 5,307,084 | A * | 4/1994 | Yamaguchi et al. | 345/87 |
| 5,307,359 | A | 4/1994 | Sarraf | |
| 5,324,962 | A | 6/1994 | Komoto et al. | 257/89 |
| 5,359,345 | A | 10/1994 | Hunter | |
| 5,393,993 | A | 2/1995 | Edmond et al. | 257/77 |
| 5,424,560 | A | 6/1995 | Norman et al. | |
| 5,450,301 | A | 9/1995 | Waltz et al. | 362/231 |
| 5,453,405 | A | 9/1995 | Fan et al. | |
| 5,512,915 | A * | 4/1996 | Leroux | 345/100 |
| 5,576,738 | A | 11/1996 | Anwyl et al. | 345/212 |
| 5,583,350 | A | 12/1996 | Norman et al. | 257/88 |
| 5,583,351 | A | 12/1996 | Brown et al. | 257/89 |
| 5,661,074 | A | 8/1997 | Tischler | 438/32 |
| 5,724,062 | A | 3/1998 | Hunter | 345/83 |
| 5,812,105 | A | 9/1998 | Van de Ven | 345/83 |

FOREIGN PATENT DOCUMENTS

| | | | | |
|---|---|---|---|---|
| EP | 0303741 | A1 | 2/1989 | G09F 9/33 |
| EP | 0 541 373 | | 5/1993 | |
| EP | 0559124 | A1 | 9/1993 | G09F 9/33 |
| GB | 2176042 | A | 12/1986 | G09G 3/32 |
| JP | 61-273590 | A | 12/1986 | |
| JP | 61273590 | | 12/1986 | |
| JP | 02-238679 | | 9/1990 | |
| JP | 3065984 | | 3/1991 | |
| JP | 04-195086 | A | 7/1992 | |
| JP | 5190898 | | 11/1992 | |
| JP | 05-041861 | A | 2/1993 | |
| JP | 541861 | | 2/1993 | |
| JP | 05-053511 | | 3/1993 | |
| JP | 552882 | | 7/1993 | |
| JP | H05-206513 | | 8/1993 | |
| JP | 252615 | | 9/1993 | |
| JP | 05-273925 | | 10/1993 | |
| JP | 06-013659 | A | 1/1994 | |
| JP | 06151974 | | 5/1994 | H01L 33/00 |
| JP | 06-175600 | | 6/1994 | |
| JP | H06-163988 | | 6/1994 | |
| JP | 06-208335 | | 7/1994 | |
| JP | H06-196759 | | 7/1994 | |
| JP | 6187575 | | 8/1994 | |
| JP | 05125028 | | 11/1994 | H09G 3/32 |
| JP | 06314079 | | 11/1994 | |
| JP | 6326364 | | 11/1994 | |
| JP | 07015044 | | 1/1995 | H01L 33/00 |
| JP | 7110672 | | 3/1995 | |
| JP | 07-110672 | A | 4/1995 | |
| JP | 07-129100 | A | 5/1995 | |
| JP | 7129100 | | 5/1995 | |
| JP | 07-147431 | | 6/1995 | |
| JP | 07183576 | | 7/1995 | H01L 33/00 |
| JP | 07-288341 | | 10/1995 | |
| JP | 7282604 | | 10/1995 | |
| JP | 07283438 | | 10/1995 | H01L 33/00 |
| JP | 7283438 | | 10/1995 | |
| JP | 07288341 | | 10/1995 | H01L 33/00 |
| JP | 07306659 | | 11/1995 | G09G 3/32 |
| JP | 07311560 | | 11/1995 | G09G 3/32 |
| JP | 07319427 | | 12/1995 | G09G 3/32 |
| JP | 07335942 | | 12/1995 | H01L 33/00 |
| JP | 08250767 | | 9/1996 | H01L 33/00 |
| JP | 09090905 | | 4/1997 | G09G 3/32 |
| JP | 09090906 | | 4/1997 | G09G 3/32 |
| JP | 09162444 | | 6/1997 | H01L 33/00 |
| JP | 09197372 | | 7/1997 | G02F 1/133 |
| JP | 09197373 | | 7/1997 | G02F 1/133 |
| JP | 09197979 | | 7/1997 | G09F 9/30 |
| JP | 09321341 | | 12/1997 | H01L 33/00 |
| JP | 10039793 | | 2/1998 | G09F 9/33 |
| JP | 10093138 | | 4/1998 | H01L 33/00 |
| JP | 10107322 | | 4/1998 | H01L 33/00 |
| JP | 10004216 | | 6/1998 | H01L 33/00 |
| JP | 11003051 | | 1/1999 | G09F 9/33 |
| JP | 11150300 | | 6/1999 | H01L 33/00 |
| JP | 2000-047639 | | 2/2000 | G09G 3/32 |
| KR | 10-1989000088 | | 4/1989 | |
| KR | 10-1990005487 | | 7/1990 | |
| KR | 10-1993-0010130 | | 9/1990 | |
| KR | 9209891 | | 11/1992 | |
| KR | 0071788 | | 10/1993 | |
| KR | 10-19940002292 | | 3/1994 | |

OTHER PUBLICATIONS

*InGaN/AlGaN Double-Heterostructure Blue LEDs*, S. Nakamura, Nichia Chemical Industries, Ltd., undated (6 pages).

*Candela-Class High-Brightness InGaN/AlGaN Double-Heterostructure Blue-Light-Emitting Diodes*, S. Nakamura et al.; Appl. Phys. Lett. 64 (13), Mar. 1994, pp. 1687-1689.

*Light-Emitting Diodes Made From Silicon Carbide Bombarded With Fast Electrons*, Y. A. Vodakov et al., Soy. Phys. Semicond. 26 (11), Nov. 1992, pp. 1041-1043.

*Three-Color Blue-Green-Red Display Made From One Single Crystal*, V. A. Dmitriev et al., Sov. Tech. Phys. Lett. 12(5), May 1988, p. 221.

*Efficient Green-Emitting Silicon Carbide Diodes*, Y. A. Vodakov et al., Sov. Plays. Semicond. 26 (1), Jan. 1992, pp. 59-61.

*Display Electronics*, K. Tracton, (First Edition 1/79), 1977, pp. 114-115.

*Toshiba LED Dot Matrix Modules Designer's Manual* (undated).

*Technical Literature for LED Dot Matrix Unit*, Model No. LT1550ED, Sharp Corporation Electronic Components Group, Jun. 1994.

Koga, K., et al., RGB Multi-Color LED Dot-Matrix Units and Their Application to Large-Size Flat Displays, *Optoelectronics-Devices and Technologies*, vol. 7, No. 2, pp. 221-229 (Dec. 1992).

Blue LED Produces 500-μW Output, *Solid State Technology*, vol. 38, No. 8, p. 30 (Aug. 1995).

Nakamura, Shuji, et al., Superbright Green InGaN Single-Quantum-Well-Structure Light-emitting Diodes, *Jpn. J. App. Phys.*, vol. 34, Part 2, No. 10B, pp. L1332-L1335 (Oct. 15, 1995).

International Search Report for International Application No. PCT/US96/20200.

Japanese Office Action (English Translation), corresponding Japanese Patent Application No. 524411/97, dated Jul. 20, 2004.

(56) References Cited

OTHER PUBLICATIONS

Notice to Submit a Response (English Translation), corresponding Korean Patent Application No. 1998-0704901, dated Sep. 24, 2003.
Notice to Submit a Response (English Translation), corresponding Korean Patent Application No. 1998-0704901, dated Dec. 2, 2003.
Notice to Submit a Response (English Translation), corresponding Korean Patent Application No. 2003-7015351, dated Jan. 12, 2004.
Notice to Submit a Response (English Translation), corresponding Korean Patent Application No. 2003-7015351, dated Sep. 14, 2004.
"5mm Multi-Color LED Development" Registration Date, Sep. 4, 1995, Abstract.
Kurihara, T. "Multicolor ST LCD module with 640*480 pixels" IEEE Trans. Consum. Electron (USA) IEEE Transactions on Consumer Electronics, 36(3), pp. 467-472 (Abstract).
Koga et al. "Single crystals of SiC and their applications to blue LEDs," Prog. Cryst. Growth and Characterization of Materials, vol. 23, pp. 127-151, 1992 (Abstract).
Marks, M. "Graphics capable LCD module," Elektron. Entwick. (West Germany) Eleik Entwicklung 22(9), p. 38, 38, 1987 (Abstract).
Okazaki, A. "Dot matrix LCD module with 2000 characters display," Conference Proceeding TENCON (IEEE Cat. No. 84CH1995-0), pp. 89-94, 1984 (Abstract).
The TLC-651 LCT module, Elektron. Appl. (West Germany) Elektronik Applikation, 13(2), pp. 44, 1981 (Abstract).
Kazuyuki et al. "RGB Multi-Color LED Dot-Matrix Units and Their Application to Large-Size Flat Displays" *Optoelectronics—Devices and Technologies* 7(2):221-229 (1992).
Japanese Office Action (English Translation), corresponding Japanese Patent Application No. 524411/97, dated Feb. 15, 2005.
Notice to Submit a Response (English Translation), corresponding Korean Patent Application No. 2003-7015351, dated Mar. 15, 2005.
Notification of Reasons for Rejection from Japanese Patent Office Corresponding to Japanese Patent Application No. 2008-196758; Draft Date: Oct. 13, 2011; 3 pages.

* cited by examiner

TRUE COLOR FLAT PANEL DISPLAY MODULE

CROSS REFERENCE TO RELATED APPLICATIONS

This application is a continuation of and claims priority to U.S. patent application Ser. No. 09/057,838, filed on Apr. 9, 1998 now U.S. Pat. No. 7,385,574 that is a divisional of U.S. patent application Ser. No. 08/580,771 filed on Dec. 29, 1995 now abandoned, the disclosures of which are hereby incorporated herein by reference as if set forth in their entirety.

FIELD OF THE INVENTION

The present invention relates to electronic displays, and in particular relates to true color flat panel modular electronic displays in which the individual elements are light emitting diodes.

BACKGROUND OF THE INVENTION

Electronic displays are those electronic components that can convert electrical signals into visual images in real time that are otherwise suitable for direct interpretation—i.e. viewing—by a person. Such displays typically serve as the visual interface between persons and electronic devices such as computers, televisions, various forms of machinery, and numerous other applications.

The use of electronic displays has grown rapidly in recent years driven to some extent by the personal computer revolution, but also by other utilitarian and industrial applications in which such electronic displays have begun to partially or completely replace traditional methods of presenting information such as mechanical gauges, and printed paper.

One of the most familiar types of electronic display is the conventional television in which a cathode ray tube (CRT) produces the image. The nature and operation of cathode ray tubes has been well understood for several decades and will not be otherwise discussed in detail herein, except to highlight the recognition that the nature of a CRT's operation requires it to occupy a three-dimensional area that generally is directly proportional to the size of the CRT's display surface. Thus, in the conventional television set or personal computer, the CRT display tends to have a depth that is the same as, or in some cases greater than, the width and height of its display screen.

Accordingly, the desirability for an electronic display that can use space more efficiently has been well recognized for some time, and has driven the development of a number of various devices that are often referred to collectively as "flat-panel displays." A number of techniques have been attempted, and some are relatively well developed, for flat-panel displays. These include gas discharge, plasma displays, electroluminescence, light emitting diodes (LEDS), cathodoluminescence, and liquid crystal displays (LCDs). To date, flat panel technologies have been generally widely used in certain portable displays and in numerical displays that use fewer (i.e. less than several hundred) characters. For example, the typical display on a hand-held calculator can be characterized as a flat-panel display even though it tends to operate in only one color, typically using either LEDs or LCDs.

Light emitting diodes have generally been recognized as likely candidate devices for flat panel displays for a number of reasons. These include their solid state operation, the ability to make them in relatively small sizes (thus potentially increasing resolution), and potentially a relatively low cost of manufacture. To date, however, flat panel displays incorporating LEDs have failed to reach their theoretical potential in the actual marketplace.

LED flat panel displays have lacked success in penetrating the technology and the marketplace for several reasons. One basic reason is the lack of suitable or commercial acceptable LEDs in the three primary colors (red, green and blue), that can be combined to form appropriate true color flat panel images. In that regard, color can be defined for certain purposes as "that aspect of visual sensation enabling a human observer to distinguish differences between two structure-free fields of light having the same size, shape and duration." *McGraw-Hill Encyclopedia of Science and Technology,* 7th Edition, Volume 4, p. 150 (1992). Stated differently, color can be formed and perceived by the propagation of electromagnetic radiation in that portion of the electromagnetic spectrum that is generally referred to as "visible." Typically, if the electromagnetic spectrum is considered to cover wavelengths from the long electrical oscillations (e.g. $10^{14}$ micrometers) to cosmic rays ($10^{-9}$ micrometers), the visible portion of the spectrum is considered to fall from about 0.770 micrometers (770 nanometers "nm") to about 0.390 micrometers (390 nm). Accordingly, to emit visible light of even a single color, a light emitting diode must produce radiation with a wavelength of between about 390 and 770 nm. In that regard, the theory and operation of light emitting diodes and related photonic devices in general are set forth in appropriate fashion in Sze, *Physics of Semiconductor Devices*, Second Edition, pp. 681-838 (1981) and will not otherwise be discussed in great detail herein, other than as necessary to describe the invention. A similar but more condensed discussion can be found in Dorf, *The Electrical Engineering Handbook*, pp. 1763-1772 (CRC Press 1983).

In order for a display of light emitting diodes to form combinations of colors, those diodes must emit primary colors that can be mixed to form other desired colors. A typical method for describing color is the well-recognized "CIE chromaticity diagram" which was developed several decades ago by the International Commission on Illumination (CIE), and a copy of which is reproduced herein as FIG. 6. The CIE chromaticity diagram shows the relationship among colors independent of brightness. Generally speaking, the colors visible to the human eye fall on the CIE chart within an area defined by a boundary. As FIG. 6 shows, the boundary is made up of a straight line between 380 and 660 nm, and a curved line which forms the remainder of the generally cone-shaped area.

Although the color perceptions of individual persons may of course differ, it is generally well understood and expected that colors visible by most persons fall within the boundaries of the CIE diagram.

Accordingly, the color output of electronic displays, including flat panel displays, can be plotted on the CIE diagram. More particularly, if the wavelengths of the red, green, and blue primary elements of the display are plotted on the CIE diagram, the color combinations that the device can produce are represented by the triangular area taken between the primary wavelengths produced. Thus, in FIG. 6, the best available devices are plotted as the lines between the wavelengths of about 655 or 660 nanometers for aluminum gallium arsenide (AlGaAs) red devices, about 560 nanometers for gallium phosphide green devices, and about 480 nanometers for silicon carbide (SiC) blue devices. Gallium phosphide can also be used in red-emitted devices, but these generally emit in the 700 nm range. Because the human eye is less responsive at 700 nm, the devices tend to lack brightness and thus are often limited to applications where maximum brightness is less critical. Similarly, silicon carbide blue devices have only been commercially available for approximately a decade. As the triangle formed by joining these wavelengths on the CIE diagram demonstrates, there exist entire ranges of colors in both the upper and lower portions of the CIE diagram that even these most recently available displays simply cannot produce by the limitations of the physics of their LEDs.

Stated somewhat more simply, although certain LED displays can be described as "full color," they cannot be classified as "true color" unless and until they incorporate LEDs that are respectively more green, more red, and more blue, and that are formed from devices that can have sufficient brightness to make the devices worthwhile. For simplicity's sake, however, the terms "full color" and "true color" are used synonymously hereinafter.

In regard to color and brightness, and as set forth in the reference materials mentioned above, the characteristics of an LED depend primarily on the material from which it is made, including its characteristic as either a direct or indirect emitter. First, as noted above and as generally familiar to those in the electronic arts, because blue light is among the shortest wavelengths of the visible spectrum, it represents the highest energy photon as among the three primary colors. In turn, blue light can only be produced by materials with a bandgap sufficiently wide to permit a transition in electron volts that corresponds to such a higher energy shorter wavelength photon. Such materials are generally limited to silicon carbide, gallium nitride, certain other Group III nitrides, and diamond. For a number of reasons, all of these materials have been historically difficult to work with, generally because of their physical properties, their crystallography, and the difficulty in forming them into both bulk crystals and epitaxial layers, both of which are generally (although not exclusively) structural requirements for light emitting diodes.

As noted above, some SiC blue LEDs—i.e. those in which SiC forms the active layer—have become available in commercially meaningful quantities in recent years. Nevertheless, the photon emitted by SiC results from an "indirect" transition rather than a "direct" one (see Sze supra, §12.2.1 at pages 684-686). The net effect is that SiC LEDs are limited in brightness. Thus, although their recent availability represents a technological and commercial breakthrough, their limited brightness likewise limits some of their applicability to displays, particularly larger displays that are most desirably used in bright conditions; e.g. outdoor displays used in daylight.

Accordingly, more recent work has focused on Group III (Al, In, Ga) nitrides, which have bandgaps sufficient to produce blue light, and which are direct emitters and thus offer even greater brightness potential. Group III nitrides present their own set of problems and challenges. Nevertheless, recent advances have placed Group III nitride devices into the commercial realm, and a number of these are set forth in related patents and copending applications including U.S. Pat. No. 5,393,993 and Ser. No. 08/309,251 filed Sep. 20, 1994 for "*Vertical Geometry Light Emitting Diode With Group II Nitride Active Layer and Extended Lifetime*"; Ser. No. 08/309,247 filed Sep. 20, 1994 for "*Low Strain Laser Structure With Group III Nitride Active Layers*"; and Ser. No. 08/436,141 filed May 8, 1995 for "*Double Heterojunction Light Emitting Diode With Gallium Nitride Active Layer*", the contents of each of which are incorporated entirely herein by reference.

As another disadvantage, flat panel displays in the current art are generally only "flat" in comparison to CRTs, and in reality have some substantial thickness. For example, a typical "flat" LED display is made up of a plurality of LED lamps. As used herein, the term "lamp" refers to one or more light emitting diodes encased in some optical medium such as a transparent polymer, and with an appropriate size and shape to enhance the perceived output of the LED. In turn, the lamps must be connected to various driving circuits, typically a multiplexing circuit that drives rows and columns in a two-dimensional matrix of such devices. These in turn require appropriate power supplies and related circuitry. The net result are devices that—although thin compared to CRTs—do have significant physical depth.

For example, LED flat panel displays of any size are typically always several inches in depth and few if any are produced that are less than an inch in depth in actual use. Indeed, some of the largest flat panel displays with which the public might be familiar (i.e. stadium scoreboards and the like) use either enough LEDs or incandescent lamps to require significant heat transfer capabilities. For example, a stadium-size flat display is typically backed by an atmospherically controlled space; i.e. an air conditioned room; to take care of the heat that is generated.

Accordingly, the need exists and remains for a flat panel display formed of light emitting diodes that can produce a full range of colors rather than simply multiple colors, and which can do so in a truly thin physical space.

SUMMARY OF THE INVENTION

Accordingly, it is an object of the present invention to provide a flat panel display that can produce a full range of true colors and that can do so in module form so that large panel displays can be formed of such modules and yet without increasing the overall thickness required for the display.

The invention meets this object with a thin full-color flat panel display module that comprises a printed circuit board, a matrix of substantially flat full-range true color pixels mounted to a first surface of the printed circuit board, with each of the pixels comprising a light emitting diode (LED) that emits in the red portion of the visible spectrum, an LED that emits in the green portion of the visible spectrum, and an LED that emits in the blue portion of the visible spectrum, combined with driving circuitry for the light emitting diodes, with the driving circuitry mounted on the opposite surface of the printed circuit board from the light emitting diodes.

In another aspect, the invention comprises a true color pixel formed of an LED that emits in the blue region of the visible spectrum, an adjacent LED that emits in the green region of the visible spectrum, the blue LED and the green LED having their respective top contacts in substantially the same plane, and an adjacent LED that emits in the red region of the visible spectrum in which the red LED includes at least one active layer of aluminum gallium arsenide (AlGaAs) and has its respective top anode contact in substantially the same plane as the anode contacts of the blue LED and the green LED.

In another aspect, the invention comprises a true color pixel formed of a blue LED, a red LED and a green LED, in which the blue LED comprises a silicon carbide substrate and a Group III nitride active layer.

In yet another aspect, the invention comprises a true color pixel formed of solid state light emitting diodes that can form any color on that portion of a CIE curve that falls within a triangle whose sides are formed by a line on the CIE curve between 430 nm and 660 nm, a line between 660 nm and a point between 500-530 nm and a line between the 500-530 nm point and 430 nm.

In a further aspect, the invention comprises a full-range, true color flat panel display module comprising a pixel matrix formed of n rows and 2n columns, where n is a power of 2; and means for driving the matrix in two sets of blocks with n/2 rows per block, to thereby allow more brightness per pixel, lower clock update speeds, and a generally more efficient use of power.

In another aspect, the invention comprises a thin full-range, true color flat panel display module comprising a matrix of LED pixels arranged in horizontal rows and vertical rows (columns) on a printed circuit board in which each of the pixels comprises four respective quadrants. Each pixel has a red LED in a first quadrant, a green LED in a second quadrant, a blue LED in a third quadrant, and a common contact pad in the fourth quadrants. The LEDs have the same quadrant relationship to each other within each pixel. The pixels in each column have their quadrants identically oriented and the quadrants in the pixels in any given column are oriented 90° with respect to the pixels in the adjacent column to thereby position the common contact pad in each pixel in one column adjacent the common contact pads in each pixel in an adjacent column.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments and wherein:

DETAILED DESCRIPTION OF THE PREFERRED EMBODIMENTS

The present invention is a thin flat panel display module that can produce a full range of true colors. As set forth above, the term true color refers to a much greater range of colors than have been previously available from prior devices incorporating either light emitting diode or other technologies.

The invention provides a thin flat panel display module suitable as a subassembly for construction of any size, although predominantly wall sized, thin flat panel displays. The modules of the invention are capable of displaying portions of any visual image, either moving or stationary, in either any color or combination of colors. By combining modules horizontally and vertically, virtually any size of display board can be constructed.

Figure 1:
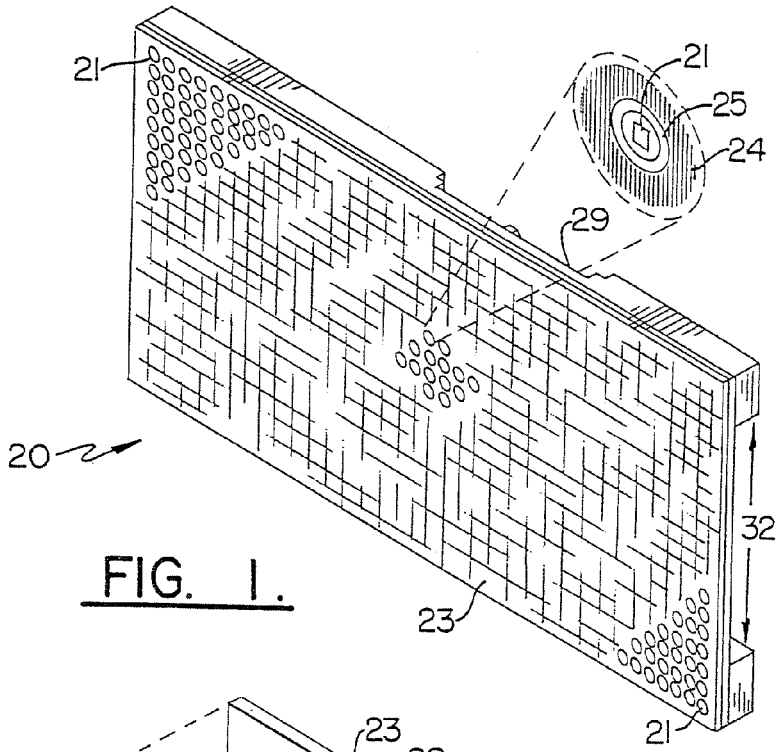
FIG. 1 is a perspective view of a module according to the present invention.
Figure 2:
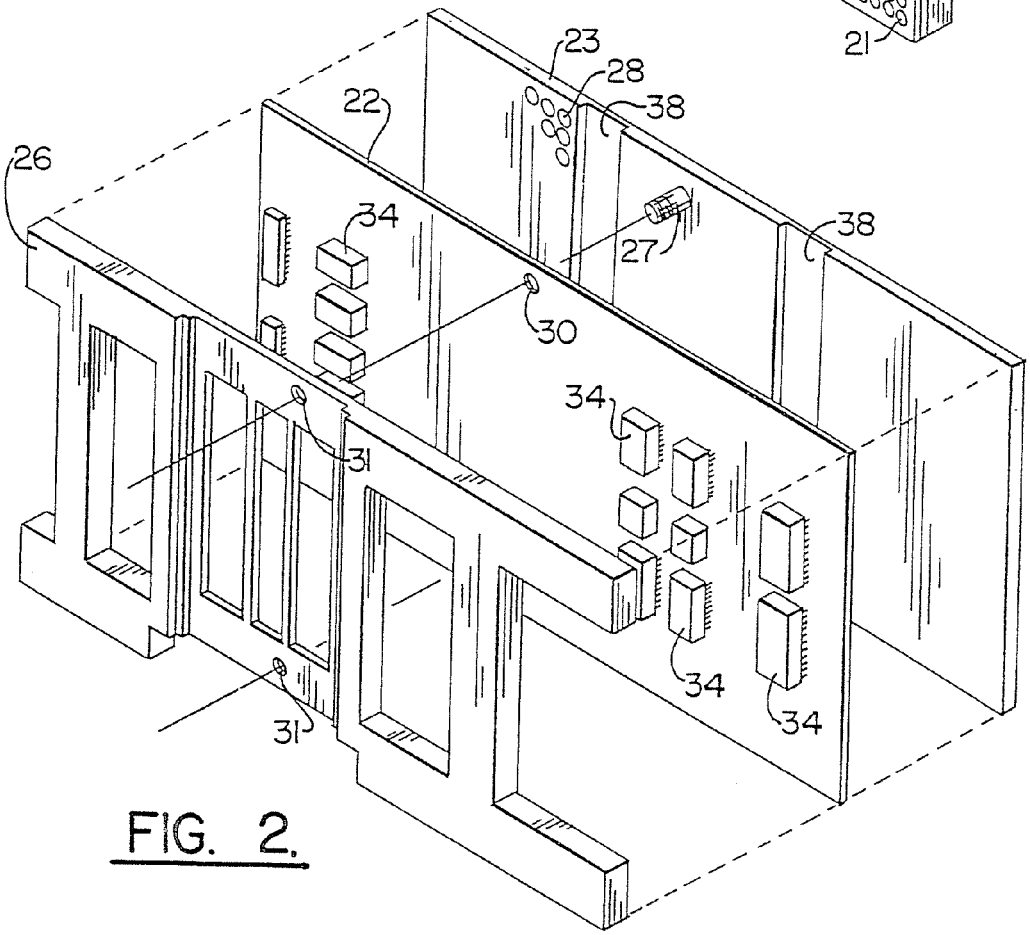
FIG. 2 is a perspective view of the rear portion of the module of FIG. 1.

FIGS. 1 and 2 are front and rear perspective views showing the module broadly designated at 20. A matrix of substantially flat full color pixels, several of which are labelled as 21 in FIG. 1 are mounted on a first surface of a printed circuit board 22. As will be set forth in more detail herein, each of the pixels 21 comprises a red LED, a green LED and a blue LED. As perhaps best illustrated in FIG. 2, the driving circuitry for the light emitting diode pixels is mounted on the opposite surface of the printed circuit board 22.

It will also be understood that a pixel could include more than one LED of one or more of the colors as might be desired for certain applications of the pixels and the modules. For the sake of brevity, however, the pixels herein will be described in terms of one red, one green, and one blue LED.

FIG. 1 further illustrates that the module 20 also comprises a front masking plate 23 on the same surface of the printed circuit board as the pixels 21. As further illustrated in the enlarged portion of FIG. 1, the front masking plate can comprise contrast enhancement means which in the illustrated embodiment comprises the dark portions 24 of the masking plate 23 and the white reflector portions 25. Whenever an individual pixel 21 is lighted, the contrast between the dark portion 24 and the white portion 25 combined with the output of the pixel can help enhance the overall image to persons viewing it.

In preferred embodiments the front masking plate 23 comprises a molded plastic panel, typically a plastic such as acrylonitrile butadiene styrene copolymer (ABS), with a matrix of holes 28 dissecting the front and back of the panel so that the holes are arranged in a matrix of the same or substantially similar position and size as the pixels 21 mounted on the printed circuit board 22. In the preferred embodiments, the walls of the holes 28 are at an angle to thereby provide a means of reflecting light emitted obliquely from the pixels 21 forward from the module and the size of the holes at the front of the display are of a sufficient diameter, relative to the pitch of the holes, to provide a suitably high density and a pleasant visual image, while leaving sufficient area surrounding each of the holes to provide a contrast ratio.

The preferred embodiment uses a ratio of hole to pixel pitch of not less than 5.5 to 7.62. As noted above, the inside surfaces 25 of the holes are either white or some similar reflective color, while the area 24 surrounding the holes is of a dark or contrasting color.

FIG. 2 shows that the display module 20 can further comprise a supporting frame 26 on the opposite surface of the printed circuit board from the pixels 21. In preferred embodiments, the front masking plate further comprises a post 27. The printed circuit board 22 comprises a clearance hole 30 that can be aligned with the post 27, and through which the post 27 extends. The supporting frame 26 includes means, shown as the holes 31, for receiving the posts 27 and into which the posts 27 are received, as well as means, such as a threaded interior (not shown) of the post 27, which when combined with a screw or bolt secures the frame 26 to the post 27. These features secure the front masking plate 23 to the supporting frame 26 with the printed circuit board 22 therebetween and thereby minimize or prevent dislocation between the printed circuit board 22 and the masking plate 23 or the frame 26, but while allowing the printed circuit board and the frame 26 to move independently enough to avoid damage in the case of thermal expansion.

As FIG. 2 illustrates, in preferred embodiments the frame 26 defines a first slot 32 adjacent the printed circuit board 22 for permitting the flow of air between the frame 26 and the printed circuit board 22 to aid in the dissipation of heat. In a further aspect of the preferred embodiment, the frame 26 also comprises a conductive mounting means opposite the printed circuit board 22 for removably clipping the module to a power source. The mounting means preferably comprises a second slot 29 opposite the printed circuit board from the pixels that can be connected to a standard power source such as a bus bar.

In preferred embodiments, the front masking plate 23 can also comprise several slots 38 for air flow, and can further comprise a conductive coating, typically a spray painted conductive coating, that is in contact with the ground signal of the driving circuitry to thereby reduce the electromagnetic emissions of the module 20.

The module 20 of the present invention also comprises driving circuitry shown as the circuit elements in FIG. 2, several of which are designated at 34. The circuit elements 34 are interconnected with the pixels 21 through the printed circuit board 22. By mounting the driving circuitry on the same printed circuit board as the pixels, the invention provides an extremely narrow profile for the module regardless of the overall size of a single module (i.e. rows and columns), and regardless of how many modules are combined to form a total display.

Figure 3:
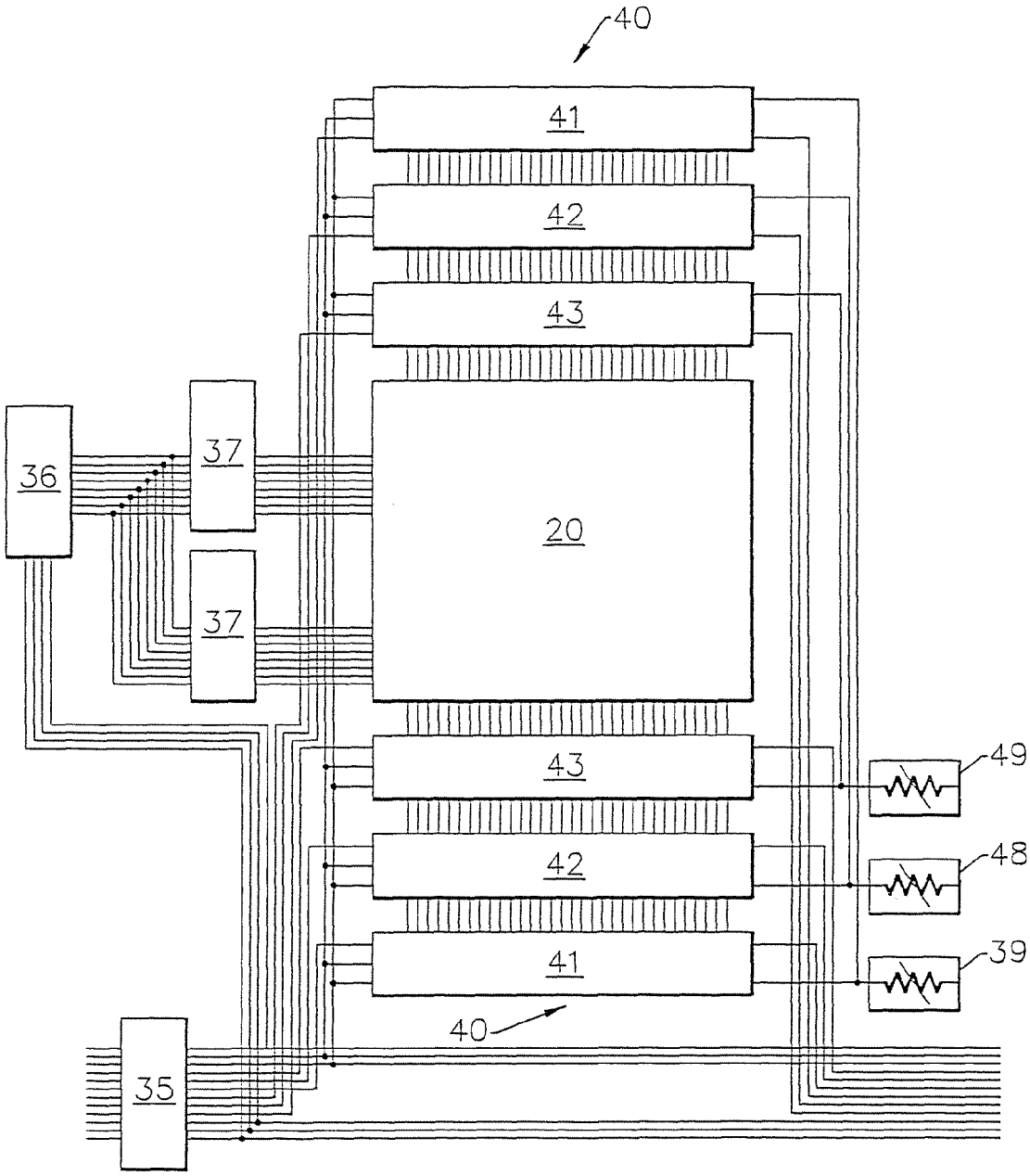
FIG. 3 is a circuit diagram illustrating a portion of the driving circuitry for the module of the present invention.

FIG. 3 illustrates some of the specified circuit elements of the present invention. Preferably the driving circuitry comprises an input buffer 35, demultiplexer 36 electrically responsive to the input buffer 35, a row driver 37 electrically responsive to the demultiplexer 36, and a column driver broadly designated at 40 electrically responsive to the input buffer. It will be understood, however, that a number of circuits exist, or can be designed, to drive electronic displays. See, e.g. Chapter 77 of Dorf, *The Electrical Engineering Handbook* (CRC Press, 1993) pages 1763ff. Accordingly, the circuits and elements described herein are exemplary, rather than limiting, of the claimed invention.

In preferred embodiments, the matrix comprises n rows and 2n columns where n is a power of 2 and wherein the row driver comprises two drivers each of which drive n/2 (i.e. half of) of the rows. Two such drivers 37 are shown in FIG. 3 in which each module has 16 rows and 32 columns in the matrix. Accordingly, in the preferred embodiments n is 16, 2n is 32, and n/2 is 8, so that each of the drivers (preferably field effect transistors, "FETs") drives eight rows.

FIG. 3 also illustrates that in a preferred embodiment the driving circuitry includes two sets of column drivers 40 each of which represents a respective 32 bit shift register, latch, and driver for the blue data 41 (i.e. data to drive the blue LEDs), the green data 42, and the red data 43. Three respective potentiometers 39 (blue), 48 (green) and 49 (red) control the current to the individual colors as a whole. The potentiometers can be controlled manually or digitally as may be desired or necessary.

Accordingly, the preferred embodiment is a 32×16 dot matrix LED flat panel display module which is capable of displaying approximately 16.7 million colors by combining red (660 nm), green (525 nm), and blue (430 nm) LEDs by mixing and pulse width modulation. By combining modules either horizontally, vertically, or both, virtually any size display board can be constructed. The module contains combination shift register, latch and constant current driver integrated circuits and row drive field effect transistors (FETs). The module uses a dual eight row multiplexed drive method with ⅛ duty cycle for maximum brightness and minimum clock speeds.

Data is displayed on the module using multiplexing to the display. The individual pixels are arranged in a grid matrix with the common anode of the individual LEDs connected together in horizontal rows and the different color cathodes of the LEDs connected together in columns. Each row (two banks of eight total) is connected to a p-type MOSFET current source and each column (three columns per LED column for a total of 96) is connected to a constant current sink driver and an associated shift register. On start up, all sixteen row driver FETs are turned off.

Figure 4:
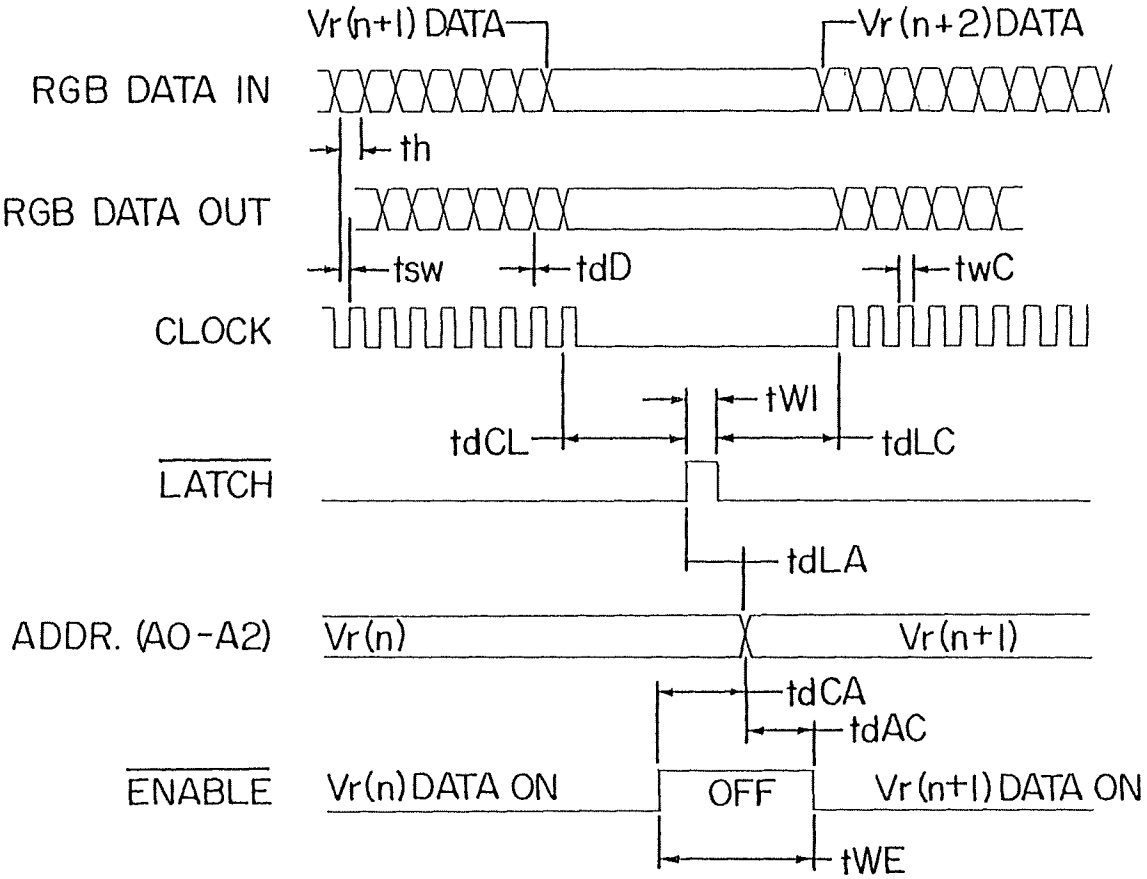
FIG. 4 is a timing diagram that illustrates the operation of the present invention.

FIG. 4 schematically illustrates the following steps that are then applied to each row consecutively commencing with the top row in a continuous repeating cycle to display a visually solid image; the number of RGB datagroups (6 bits wide) relating to a two row of lamps to be displayed next is clocked out into the six shift register banks (i.e. one bank for red, one for green and one for blue for the top eight rows and another three for the bottom eight rows) on the rising edge of the clock signal. The number of data groups shifted out should be equal to the number of columns in the display, and is 32 clock cycles in the case of the preferred embodiment. Data to be displayed on the side of the modules farthest (electronically) from the input buffer is output first. The row driver FETs are then turned off by taking the "enable" signal high. The data in the shift registers is then latched into the column drivers by pulsing the "latch" signal low for no less than 25 nanoseconds (ns). The row address to the data shifted out is then placed on the A0-A2 signals (address 0 being the top row (row 8) and seven being the bottom row (row 7) also). This value is normally incremented 0, 1, . . . 7 etc. (from top to bottom for each half of the display). The row driver FET is then enabled by taking the enable signal low. The rows of LEDs will now show the image for that row. The process is then repeated for each row in a cyclical manner accessing all rows approximately 60 times per second to display a flicker-free multiplexed visually solid image.

Further to the preferred embodiments of the invention, each pixel 21 comprises a common anode for all three of its LEDs for turning the entire pixel on or off, and an individual cathode for each individual LED in the pixel for controlling the state and brightness of each LED, to thereby control the overall color emitted by the pixel.

In preferred embodiments, the invention further comprises a monostable circuit means for preventing the maximum rating of the diodes in the pixels from being exceeded. More specifically, on the rising edge of the enable signal the output goes high or stays high for a time period set by a capacitor and resistor in series. The capacitor and resistor are adjusted such that the length of time output stays high is longer than the time between successive enable transitions. Therefore if the enable transition does not occur due to controller failure, then the output signal goes low disabling the column driver 4 and turning off the LEDs.

Figure 5:
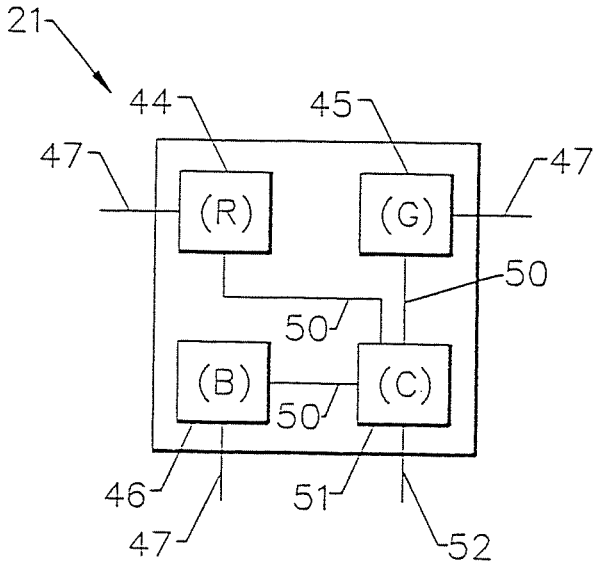
FIG. 5 is a schematic diagram of a pixel according to the present invention.
Figure 6:
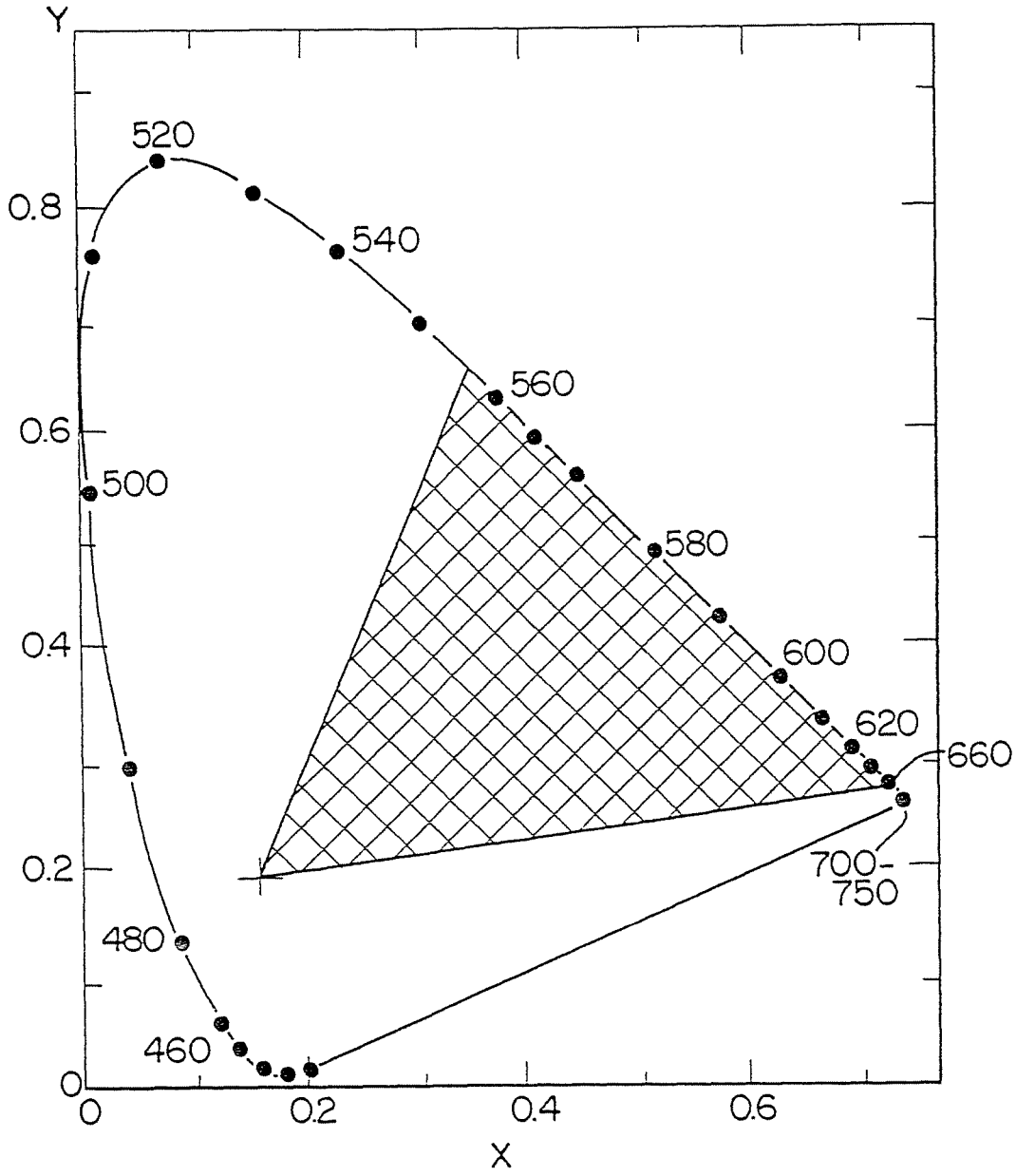
FIG. 6 is a CIE curve illustrating a portion of those visible colors typically produced by prior art multicolor devices.

As set forth in the background portion of the specification, one of the problems solved by the invention and the advantages it offers is the wide range of colors available from the LEDs which are incorporated into the pixels and thus into the matrix and the modules. Thus, in another aspect, the invention comprises a pixel. FIG. 5 illustrates such a pixel schematically and broadly designated at 21 consistent with the earlier numbering. The pixel includes an LED 44 that emits in the red portion of the visible spectrum, an LED 45 that emits in the green portion of the visible spectrum, and an LED 46 that emits in the blue region of the visible spectrum. The red, green and blue LEDs 44, 45, and 46 are adjacent one another and have their respective top contacts in substantially the same plane on the pixel. The red LED 44 includes at least one active layer of aluminum gallium arsenide (AlGaAs), and the red LED 44 also has its respective top anode contact in substantially the same plane as the anode contacts of the blue LED 46 and the green LED 45.

Similarly, the back contacts of all of the LED's can likewise be placed in a common plane (preferably different from the plane of the top contacts).

It will be immediately understood by those familiar with this subject matter that the ability to place all of the top contacts in substantially the same plane, and all of the bottom contacts in their own common plane, greatly enhances the operability of the pixels, and thus of the matrix and the entire module.

As further shown in FIG. 5, each diode has a respective diode cathode contact 47 and an anode contact 50. The anode contacts 50, however, are attached to a common anode pad 51 which in turn is connected to a common anode contact 52. This arrangement allows for the individual control described above.

In preferred embodiments, the blue LED 46 comprises a silicon carbide substrate and a Group III active nitride layer, with gallium nitride being a particularly preferred active layer. Such light emitting diodes are well described in the earlier-noted incorporated patent and copending applications.

As noted above, the red LED is preferably formed of aluminum gallium arsenide.

The green LED 45 can be formed of a Group III phosphide active layer such as gallium phosphide or aluminum indium gallium phosphide, or the green LED can preferably be formed similar to the blue LED in that it comprises a silicon carbide substrate and a gallium nitride active layer.

In embodiments in which both the blue and green LED comprise silicon carbide substrates and Group III active layers, their voltage parameters can be generally matched to one another to simplify the driving circuitry, and preferred embodiments incorporate this advantage.

In preferred embodiments, the LEDs are all driven by constant current devices, but with a resistor in series in the circuit between the constant current drive means and the cathode of the red LED 44 to compensate for the differences between the forward voltage characteristics of the red LED in aluminum gallium arsenide and the forward voltage characteristics of the matched blue and green LEDs in silicon carbide and gallium nitride.

Figure 7:
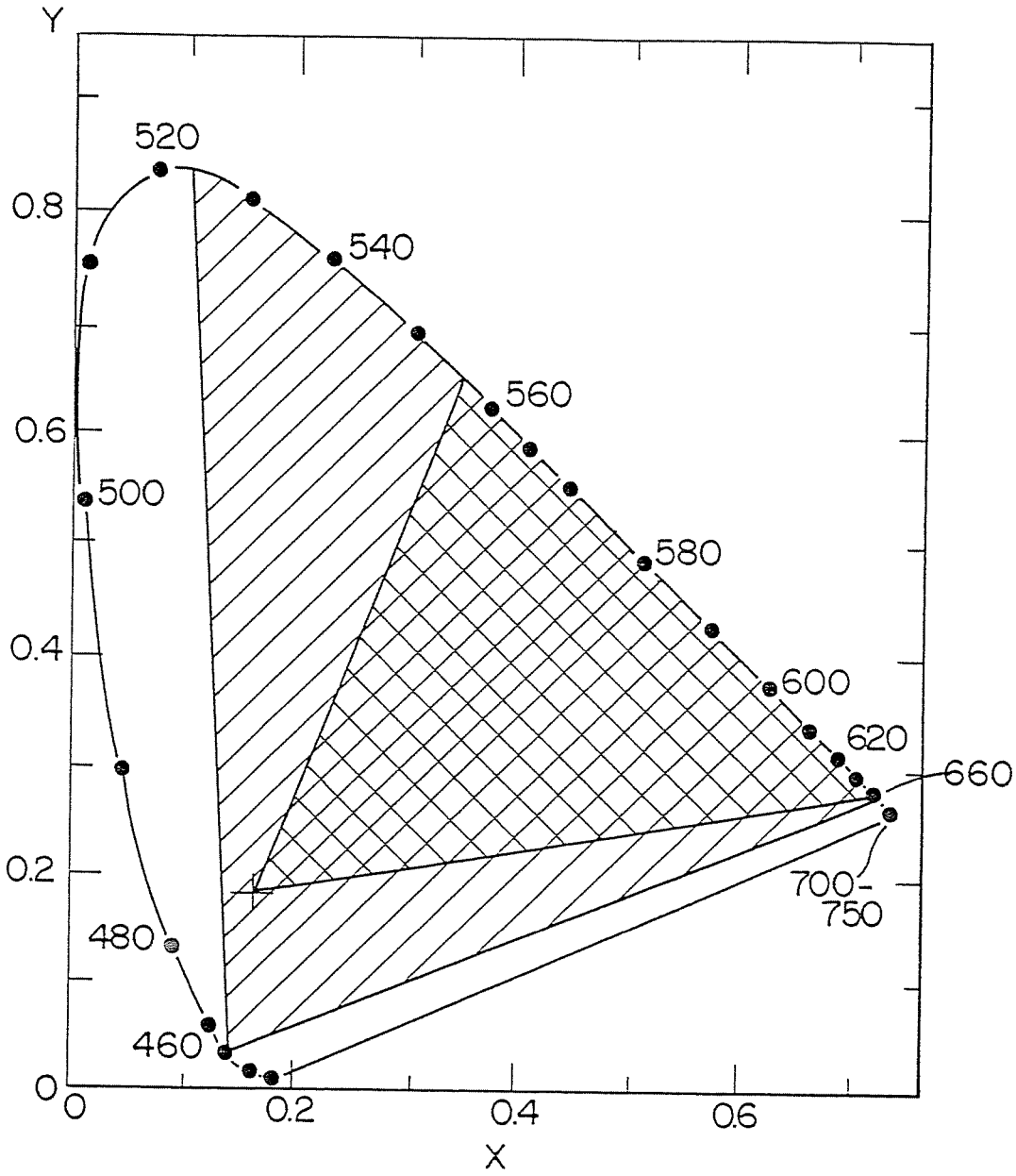
FIG. 7 is a CIE chart which shows the additional colors that can be produced by the pixels and modules of the present invention.

In another aspect, and because of the types of light emitting diodes that are incorporated in the present invention, and which were previously unavailable for such use, the invention comprises a pixel formed of solid state light emitting diodes that can form any color on that portion of a CIE curve that falls within a triangle whose sides are formed by a line on the CIE curve between 430 nm and 660 nm, a line between 660 nm and points between 500 and 530 nm, and a line between the 500-530 nm point and 430 nm. Such a CIE curve and triangle are illustrated in FIG. 7. Stated differently, because the output of the LEDs incorporated in the pixels of the present invention are essentially farther apart from one another on the CIE curve, the range of colors that can be produced by the pixels of the present invention, and thus by the modules, is much greater than that previously available. Indeed, the present invention essentially provides true color display capabilities, while previous devices have only been able to produce multicolor displays.

It will be understood, of course, that the area on the CIE curve that represents the colors produced by the invention is exemplary rather than absolute or otherwise limiting of the invention. For example, FIG. 7 illustrates the "green" corner of the color triangle as falling at about 525 nm. As noted elsewhere, herein, however, the green corner could fall from 500 to 530 nm depending on the particular diode. In such cases, the triangle defined on the CIE curve would have a slightly different appearance than FIG. 7, but one that could be easily superimposed on the CIE curve once the precise outputs of the LED's were identified.

Figure 8:
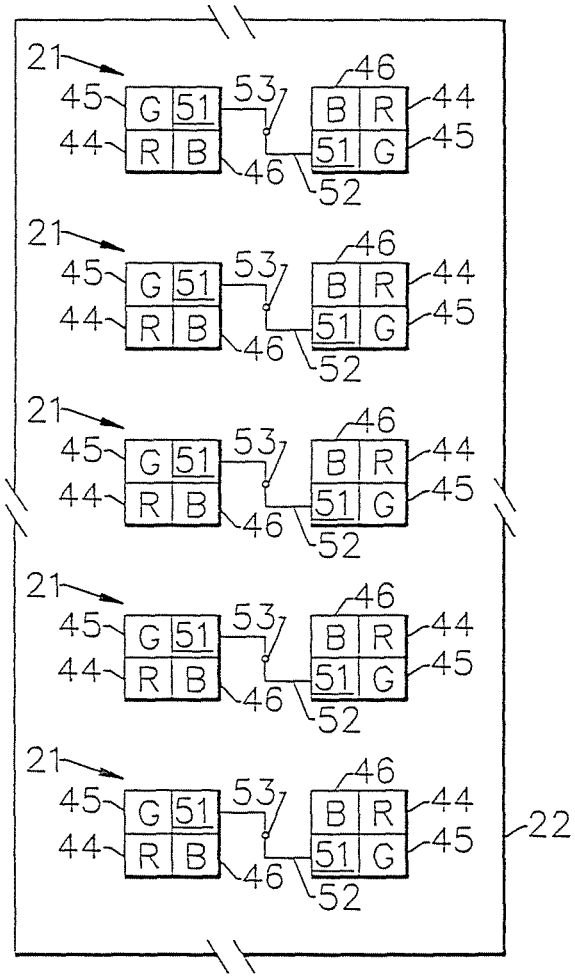
FIG. 8 is a schematic diagram of the arrangement of pixels on the printed circuit board.

In another aspect, the invention comprises a novel arrangement of the pixels on the printed circuit board. In this embodiment, the display module comprises a matrix of LED pixels arranged in horizontal rows and vertical rows (columns) on a printed circuit board, a portion of which is schematically illustrated in FIG. 8. FIG. 8 incorporates the same numbering scheme as the previous illustrations such that the printed circuit board is designated at 22 and the individual pixels at 21. Similarly, the red, green and blue LEDs are designated at 44, 45 and 46 respectively within each pixel. FIG. 8 also shows several via holes 53.

FIG. 8 further illustrates portions of five rows and two columns on the printed circuit board 22. As previously described with respect to FIG. 5, each pixel comprises four respective quadrants that are essentially defined by the positions of the red, green and blue LEDs (44, 45, 46) and the common contact pad 51 in the fourth quadrant. FIG. 8 illustrates that the LEDs have the same quadrant relationship to each other within each pixel, and that the quadrants are oriented identically in the pixels in each column. Thus, FIG. 8 illustrates that in the left hand column, the red LED 44 occupies the lower left quadrant, the green LED 45 the upper left quadrant, the blue LED 46 the lower right quadrant, and the common contact pad 51 the upper right quadrant.

In order to minimize the via holes 53 required, however, the invention advantageously rotates the orientation of alternating columns of LEDs so that the pixels in any given column are oriented either 90° or 180° opposite the pixels in the adjacent column. Thus, in the right hand column illustrated in FIG. 8, the common contact pad 51 is in the lower left quadrant, the blue LED 46 is in the upper left quadrant, the green LED 45 is in the lower right quadrant, and the red LED 44 is in the upper right quadrant. As FIG. 8 illustrates, this positions both the common contact pads 51 in the left hand column and the common contact pads 51 in the right hand column adjacent one another so that a single via hole can accommodate the lead from two LEDs can be substantially reduced. Thus, FIG. 8 illustrates that the printed circuit board 22 has one common anode via hole 53 for each two pixels with each common via hole 53 being positioned between the two adjacent columns of pixels and between the respective common anode pads 51 of the respective pixels 21 in each of the adjacent columns so that an anode lead 52 from each of the two pixels can pass through the common via hole 53 thus minimizing the total number of via holes, and the complexity of the remaining circuitry and of its manufacture and other factors, required in the printed circuit board 22.

As noted above, the common contact pad 51 preferably comprises the anode pad. The pixels 21 in this arrangement are on the module 20 in a matrix (as noted previously the preferred embodiment is two blocks of eight horizontal rows and 32 vertical columns) with the electrical connections between the common anodes for all pixels in the same horizontal row to an associated row driver and interconnections between cathodes of the same colored diodes in the vertical columns within the same block to associated constant current sink drivers. The pixels 21 are therefore provided with four controls means: the anode connection controlling whether the lamp as a complete unit is on or off and the three cathode connections controlling the state and brightness of the individual colored diodes with the lamp and therefore controlling the emitted color of the lamp.

It will be understood, of course, that the same alignment concept can be used between horizontal rows rather than columns, depending upon whether columns or rows are to be multiplexed. Similarly, although FIG. 8 illustrates the pixels in the right hand column as having been rotated 180° from those in the left hand column, a rotation of 90° counter-clockwise will produce a similarly adjacent relationship between the contact pads in each column. In the illustrated embodiment, the horizontal rows are multiplexed (as described below) so that alternating the pixel orientation on a column-by-column basis is most convenient. If desired, the module could be multiplexed vertically (i.e. by column) and the pixel orientation could be rotated on an alternating row basis. Thus, FIG. 8 and the multiplexing description that follows herein illustrate a preferred embodiment of the invention rather than limiting it.

The preferred embodiment uses a technique well known in the art as multiplex scanning wherein each row or column in the matrix is individually illuminated in a continuous succession at a sufficiently high repetition rate to form an apparently continuous visual image. Customarily such modules utilize a multiplex ratio equal to the height of the display in rows. In the case of multiple rows of modules forming the display, the rows of each module are controlled in parallel. Such means provides a low cost method of controlling a large number of pixels as only one set of column drivers is required for a large number of rows of pixels. Such arrangements can also be constructed orthorhombically such that only one set of row drivers is required or a large number of columns of pixels.

The lamps are provided with power generally equal to the number of rows multiplied by the continuous current rating of the individual diodes. Therefore, when the individual diodes have a nominal d.c. current rating of 20 milliamps (mA) and the multiplex is sixteen, up to 320 mA of current is applied. This high current stresses the diode, however, and shortens its life. Additionally, some diode materials saturate at much lower currents. Furthermore, it is generally recognized that 100 mA is the ideal maximum current to maintain lamp life.

A further problem with multiplexing sixteen rows is that sixteen separate refreshes are required within the cycle time. This results in higher shift clock speeds, and leads to the use of expensive buffers, and require extensive filtering to reduce electromagnetic emissions. Accordingly, the feature of the preferred embodiment of the invention in which the rows are split into blocks of not more than eight rows per block allows more brightness per pixel (i.e. 100 mA/8 versus 100 mA/16), lower clock update speeds, and less heat emitted from the column drivers. This splitting can, of course, be applied to modules having any number of rows greater than eight.

Figure 9:
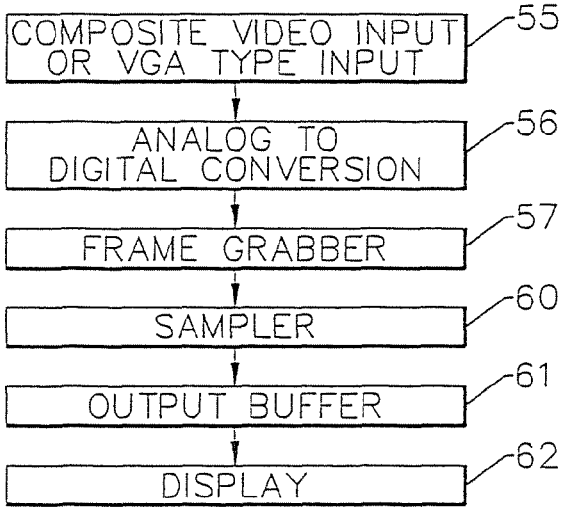
FIG. 9 is a flow diagram of one aspect of the manner in which the invention displays data.
Figure 10:
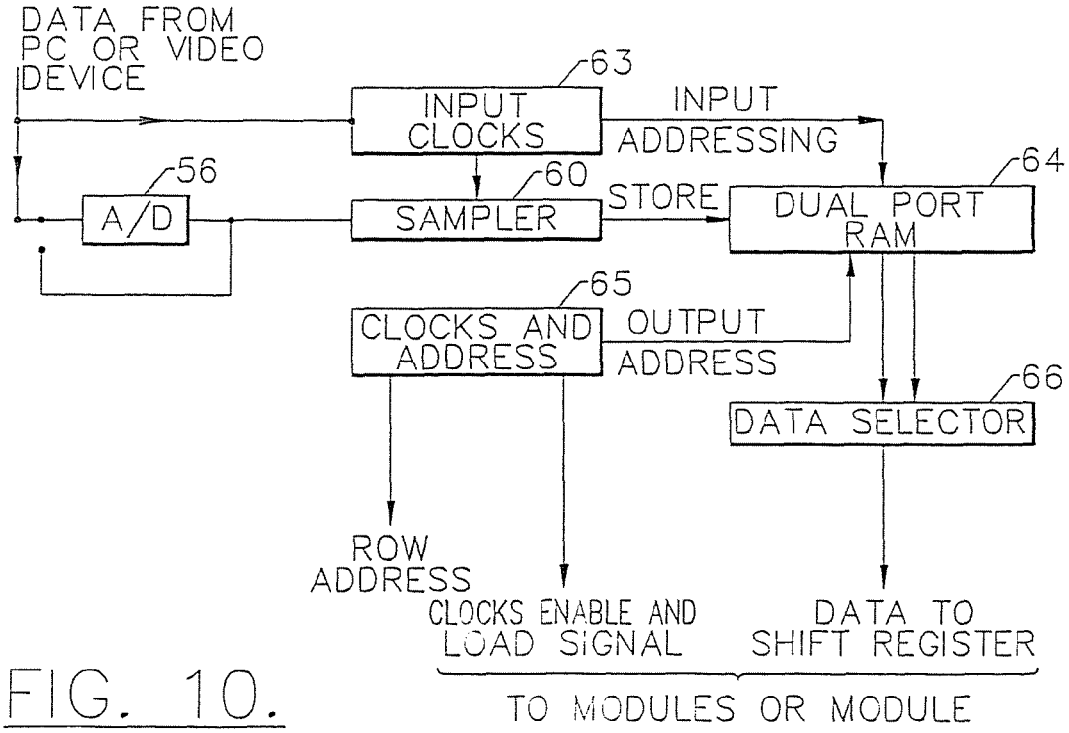
FIG. 10 is a flow diagram showing the manner in which a microprocessor controller can produce a display using a module according to the present invention.
Figure 11:
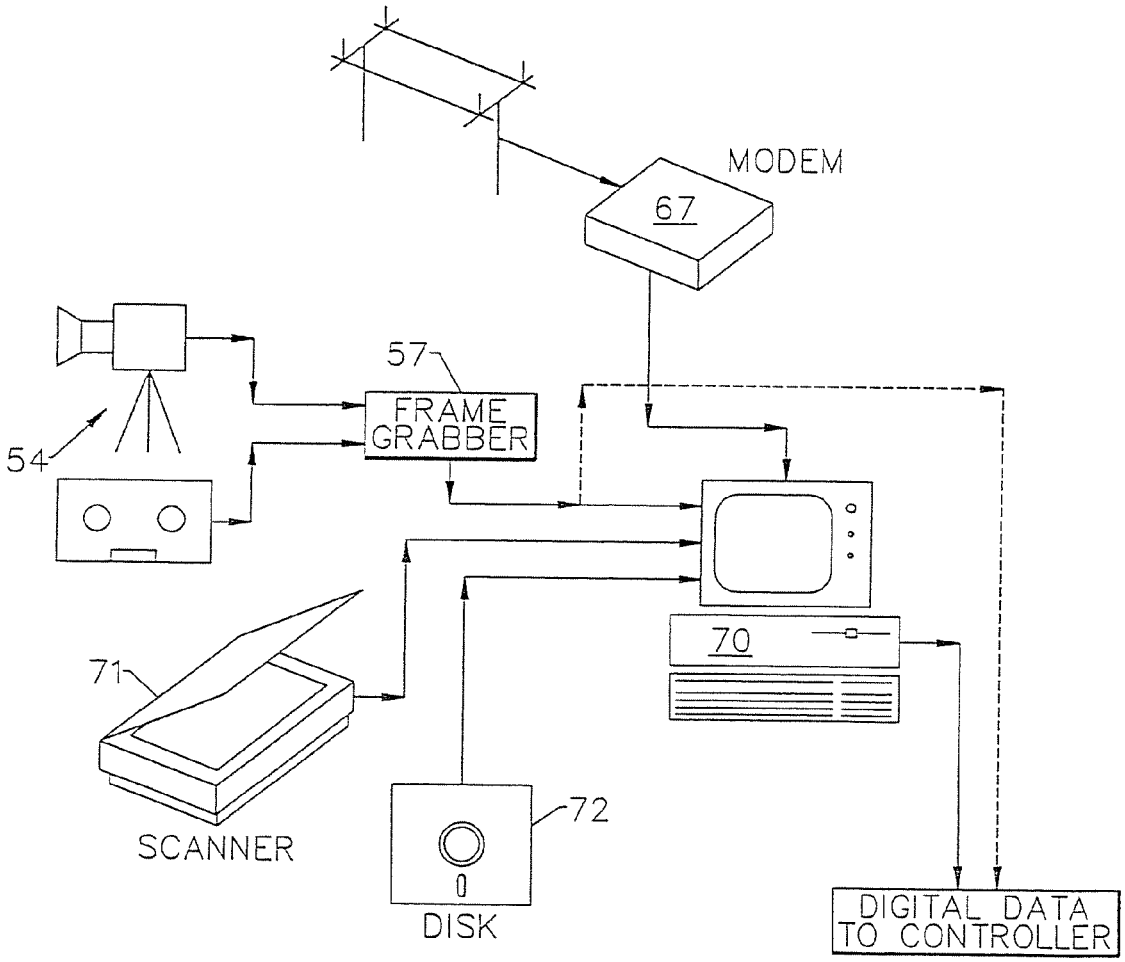
FIG. 11 is another flow diagram showing the manner in which various image information can be transmitted to the module of the present invention.

FIGS. 9, 10 and 11 further illustrate the operation of preferred embodiments of the invention. FIG. 9 is a flow diagram that shows that an image to be displayed can originate as a composite video input or as a VGA-type input. If it is a composition video input, the signal is converted from analog to digital by the analog to digital converter designated at 56. The input from either the converter 56 or the VGA input 55 then is sent to the frame grabber 57 then to the sampler 60. The frame grabber 57 synchronizes to the horizontal or vertical sync signals present at the beginning of each frame and line of a video signal.

After detecting the sync signal the digital data is stored in memory 64 with the sync signal providing a known reference so that the data can be stored in a repeatable and organized method.

Alternative frames are usually stored in alternative frame buffer areas 61 allowing the sampler 60 to read the previously grabbed frame while the frame grabber 57 stores the current frame. The signal then proceeds to the modules of the invention which form the display 62.

FIG. 10 illustrates how a microprocessor controller is used to run each of the modules. The data from the desired source proceeds to the input clock 63 which can send the data either to the sampler 60 or to random access memory ("RAM") 64. FIG. 10 again illustrates that where necessary a signal can be sent to an analog digital converter 56. The data can then be sent from RAM to the clocks and the addressing system 65, or to the data selector 66. The clocks and address selectors send the signals to the rows and columns as desired, while the data selector sends it to a shift register in the modules as previously described with respect to FIG. 5.

FIG. 11 illustrates that a display can be produced from a number of sources including information available by telecommunication lines (illustrated by the modem 67), the video input previously designated at 54 and illustrated in FIG. 10 as either a camera or a magnetic memory such as a video tape through the frame grabber 57 to the microprocessor (e.g. personal computer) 70. The information can also come from a scanner 71 or from electromagnetic memory such as the disk (or any equivalent device) 72. The microprocessor in the personal computer 70 operates in accordance with the scheme described with respect to FIGS. 9 and 10, and produces the information for the modules to display.

Although the invention has been described with respect to individual pixels, and single modules, it will be understood that one of the particularly advantageous aspects of the invention is the capability for any number of modules to be connected with one another and driven in any appropriate manner to form large screen displays of almost any size. As is well understood to those in this art, the size of the pixels and the modules can be varied depending upon the desired point source of light. In this regard, it is well understood that a plurality of light sources of a particular size will be perceived as a single point source by an observer once that observer moves a certain distance away from those multiple sources. Accordingly, for smaller displays such as televisions, the individual pixels are maintained relatively small so that an observer can sit relatively close to the display and still perceive the picture as being formed of point sources. Alternatively, for a larger display such as outdoor displays, signage and scoreboards, the observer typically views the display at a greater distance. Thus, larger pixels, larger modules and the like can be incorporated to give brighter light while still providing the optics of point sources to the more distant observers.

In the drawings and specification, there have been disclosed typical preferred embodiments of the invention and, although specific terms have been employed, they have been used in a generic and descriptive sense only and not for purposes of limitation, the scope of the invention being set forth in the following claims.

What is claimed is:

1. A light module, comprising:

a printed circuit board;

a matrix of substantially flat full color pixels mounted on a first surface of the printed circuit board, each of the pixels comprising a red light emitting diode that emits in the red portion of the visible spectrum, a green light emitting diode that emits in the green portion of the visible spectrum, and a blue light emitting diode that emits in the blue portion of the visible spectrum, wherein the pixels are arranged in a plurality of rows and columns; and a driving circuit configured to selectively activate the light emitting diodes, wherein the driving circuit comprises red, green and blue column drivers configured to selectively activate columns of red, green and blue light emitting diodes;

first, second and third individually adjustable current limiting devices coupled to respective ones of the red, green and blue column drivers; and at least one resistor in series between the driving circuit and the red light emitting diodes, wherein the driving circuit is mounted on the printed circuit board.

2. The light module of claim 1, wherein each of the pixels comprises a common anode for all three light emitting diodes of the pixel, and wherein the driving circuit is configured apply a first voltage to the common anode when the blue light emitting diode is activated and a second voltage which is different to the first voltage to the common anode when the red or green light emitting diode is activated.

3. The light module of claim 2, wherein respective ones of the common anodes in a row of pixels are electrically connected in a horizontal row.

4. The light module of claim 2, wherein cathodes of respective ones of the red light emitting diodes in a column of pixels are electrically connected in a first vertical column, cathodes of respective ones of the green light emitting diodes in a column of pixels are electrically connected in a second vertical column, and cathodes of respective ones of the blue light emitting diodes in a column of pixels are electrically connected in a third vertical column.

5. The light module of claim 1, wherein the first, second and third current limiting devices comprise respective first, second and third potentiometers.

6. The light module of claim 5, wherein the first, second and third potentiometers are configured to control current through the respective red, green and blue light emitting diodes.

7. The light module of claim 5, wherein the first, second and third potentiometers are digitally controllable.

8. The light module of claim 1, wherein the driving circuit is mounted on a second surface of the printed circuit board which is an opposite surface of the printed circuit board.

9. The light module of claim 1, wherein each of the pixels comprises individual cathodes for the red, green and blue light emitting diodes, for controlling the states and brightness of the red, green and blue light emitting diodes to thereby control the overall color emitted by the pixel.

10. The light module of claim 1, wherein the driving circuit further comprises:

an input buffer;

a demultiplexer responsive to an output of the input buffer; and a row driver responsive to an output of the demultiplexer.

11. The light module of claim 1, further comprising a mono stable circuit means for detecting the assertion of one or more of periodic input signals, and for disabling the power to the pixel when such input signals are absent for a predetermined time period.

12. The light module of claim 1, wherein the driver circuit is further configured to control the light emitting diodes using pulse width modulation.

13. The light module of claim 1, wherein each of the red light emitting diode, the blue light emitting diode and the green light emitting diode of at least one pixel has a respective top contact, wherein the respective top contacts of the red light emitting diode, the blue light emitting diode and the green light emitting diode are in substantially a same plane.

14. A light module, comprising:

a printed circuit board;

a matrix of pixels mounted on a first surface of the printed circuit board, wherein the pixels are arranged in a plurality of rows and columns; and a driving circuit configured to selectively activate the light emitting diodes, wherein the driving circuit comprises two sets of red, green and blue column drivers wherein each set of column drivers is configured to drive LEDs in one half the columns of pixels;

a first individually adjustable current limiting device coupled to the two red column drivers;

a second individually adjustable current limiting device coupled to the two green column drivers; and a third individually adjustable current limiting device coupled to the two blue column drivers.

15. The light module of claim 14, wherein the driving circuit comprises two row drivers, wherein each row driver is configured to drive one half of the rows of pixels.

16. The light module of claim 15, wherein the row drivers are configured to simultaneously drive two different rows of pixels.

17. The light module of claim 15, wherein the row drivers comprise constant current sources and the column drivers comprise constant current sink drivers, wherein the individually adjustable current limiting devices first, second and third potentiometers coupled to the red, green and blue column drivers respectively and configured to regulate current through respective ones of the red, green and blue light emitting diodes.

18. A light module, comprising:

a printed circuit board;

a matrix of pixels mounted on a first surface of the printed circuit board, wherein the pixels are arranged in a plurality of rows and columns, and wherein each of the pixels comprises first, second and third color light emitting diodes; and a driving circuit configured to selectively activate the light emitting diodes, wherein the driving circuit comprises column drivers configured to selectively activate columns of pixels, and first, second and third individually adjustable current limiting devices coupled to respective ones of the column drivers that control the current supplied to the respective first, second and third color light emitting diodes in the columns of pixels, wherein the first, second and third individually adjustable current limiting devices comprise respective first, second and third potentiometers;

wherein the driving circuit is configured to selectively activate the light emitting diodes of a selected pixel by pulse width modulation to thereby vary a color of light emitted by the selected pixel.

19. The light module of claim 18, wherein the first, second and third potentiometers are electronically controlled.

20. The light module of claim 18, further comprising at least one resistor in series between the driving circuit and the first color light emitting diodes that are included in a column of pixels.

* * * * *

UNITED STATES PATENT AND TRADEMARK OFFICE

CERTIFICATE OF CORRECTION

PATENT NO. : 8,766,885 B2
APPLICATION NO. : 12/133060
DATED : July 1, 2014
INVENTOR(S) : Van de Ven et al.

It is certified that error appears in the above-identified patent and that said Letters Patent is hereby corrected as shown below:

In the Claims:

Column 14, Claim 17, Line 32:

Please correct "limiting devices first, second"

to read -- limiting devices comprise first, second --

Signed and Sealed this
Thirtieth Day of December, 2014

Michelle K. Lee

Michelle K. Lee
*Deputy Director of the United States Patent and Trademark Office*